US005423717A

United States Patent [19]

Boaz

[11] Patent Number: 5,423,717

[45] Date of Patent: Jun. 13, 1995

[54] GRINDING WHEEL ASSEMBLY

[75] Inventor: Premakaran T. Boaz, Livonia, Mich.

[73] Assignee: Ford Motor Company, Dearborn, Mich.

[21] Appl. No.: 131,342

[22] Filed: Oct. 4, 1993

[51] Int. Cl.[6] ..... B24D 5/10

[52] U.S. Cl. ..... 451/449; 451/540

[58] Field of Search ..... 451/449, 450, 540, 541, 451/546, 547, 53, 177, 178, 182

[56] References Cited

U.S. PATENT DOCUMENTS

| | | | |
|---|---|---|---|
| 2,527,762 | 10/1950 | Pratt | 51/266 |
| 2,735,236 | 2/1956 | Townshend | 51/267 |
| 2,746,220 | 5/1956 | Thomas | 51/266 |
| 2,826,019 | 3/1958 | Garrison | 51/267 |
| 3,145,511 | 8/1964 | Bird et al. | 51/266 |
| 3,161,995 | 12/1964 | Lindblad | 51/266 |
| 3,282,263 | 11/1966 | Christensen et al. . | |
| 3,417,517 | 12/1968 | Rose | 51/356 |
| 3,459,379 | 8/1969 | Brown | 241/38 |
| 3,483,858 | 12/1969 | Jansen | 125/13 |
| 3,777,443 | 12/1973 | Shaw | 451/449 |
| 4,193,228 | 3/1980 | Bowler | 51/170 |
| 4,570,609 | 2/1986 | Hogue | 125/13 |
| 4,624,237 | 11/1986 | Inoue | 125/15 |
| 4,854,087 | 8/1989 | Riha | 51/209 |
| 4,870,946 | 10/1989 | Long et al. | 125/13 |
| 5,040,341 | 8/1991 | Okinaga | 51/266 |
| 5,111,624 | 5/1992 | Shoenhau et al. | 51/178 |

FOREIGN PATENT DOCUMENTS 872234 1/1980 U.S.S.R. .

*Primary Examiner*—Maurina T. Rachuba

*Attorney, Agent, or Firm*—Lorraine S. Melotik; Roger L. May

[57] ABSTRACT

A grinding wheel assembly is provided for shaping and finishing the edges of planar workpieces, such as glass sheets. The assembly comprises a rotatable support member, a grinding wheel fixedly connected to the support member for rotation therewith, and an impeller positioned within the grinding wheel and fixedly connected to the support member for rotation with the support member and the grinding wheel. The grinding wheel includes a plurality of bores extending between inner and outer circumferential surfaces thereof. The impeller includes an inlet for receiving a fluid and a plurality of curvilinear vanes for forcing the fluid radially outwardly toward the grinding wheel so that at least a portion of the fluid passes through the bores in the grinding wheel.

19 Claims, 2 Drawing Sheets

GRINDING WHEEL ASSEMBLY

BACKGROUND OF THE INVENTION

The present invention relates generally to a grinding wheel assembly and, more particularly, to such an assembly having improved coolant delivery capabilities.

Grinding wheels have been used in the past for finishing edges of planar workpieces, such as glass sheets. For example, grinding wheels have been used in the past to form rounded or beveled profiles on edges of glass sheets which are used as door glazings in automotive vehicles. A standard rotational speed for a grinding wheel used to finish the edge of a glass sheet is approximately 3600 RPM. During such high speed grinding operations, an excessive amount of heat is generated in the grinding area and coolant fluids have been used in the past to dissipate the heat. Such fluids also serve to suppress dust and flush away ground particles.

In one known grinding wheel assembly used for finishing glass sheet edges, cooling is accomplished by spraying water in the vicinity of the grinding area. A sufficient quantity of the sprayed water makes its way to the grinding area for effective cooling if the sheet is fed to the grinding wheel at a limited feed rate and only a limited depth of cut is accomplished. If, however, the glass feed rate and/or the depth of cut is excessive, an undesirable build-up of heat in the grinding area may occur.

It would be desirable to have a grinding wheel assembly having improved coolant delivery capabilities to allow the feed rate of a glass sheet and/or the depth of cut to be increased without causing an unacceptable build-up of heat in the grinding area.

SUMMARY OF THE INVENTION

With the present invention, an improved grinding wheel assembly is provided having improved coolant delivery capabilities. The assembly comprises a rotatable support member, a grinding wheel fixedly connected to the support member, and an impeller positioned within the grinding wheel and fixedly connected to the support member for rotation with the support member and the grinding wheel. The grinding wheel includes a plurality of bores extending between its inner and outer circumferential surfaces. The grinding wheel also includes a channel in its outer circumferential surface which channel communicates with the bores. The impeller receives a coolant fluid, such as water, through an inlet. A plurality of vanes on the impeller force the fluid radially outwardly toward the grinding wheel so that at least a portion of the fluid passes through the bores in the grinding wheel and into the channel.

Preferably, the vanes have a curvilinear shape. This permits the grinding wheel assembly to be rotated at high speeds, e.g., 3600 RPM, without the water vaporizing as it is being forced radially outwardly toward the outer circumferential surface of the grinding wheel.

A spaced gap extends between the outer edge of the impeller and the inner circumferential surface of the grinding wheel. This gap allows sufficient circulation of the fluid to occur within the assembly to prevent a build-up of glass particles on the inner circumferential surface of the grinding wheel and within the bores.

DETAILED DESCRIPTION OF THE INVENTION

Figure 1:
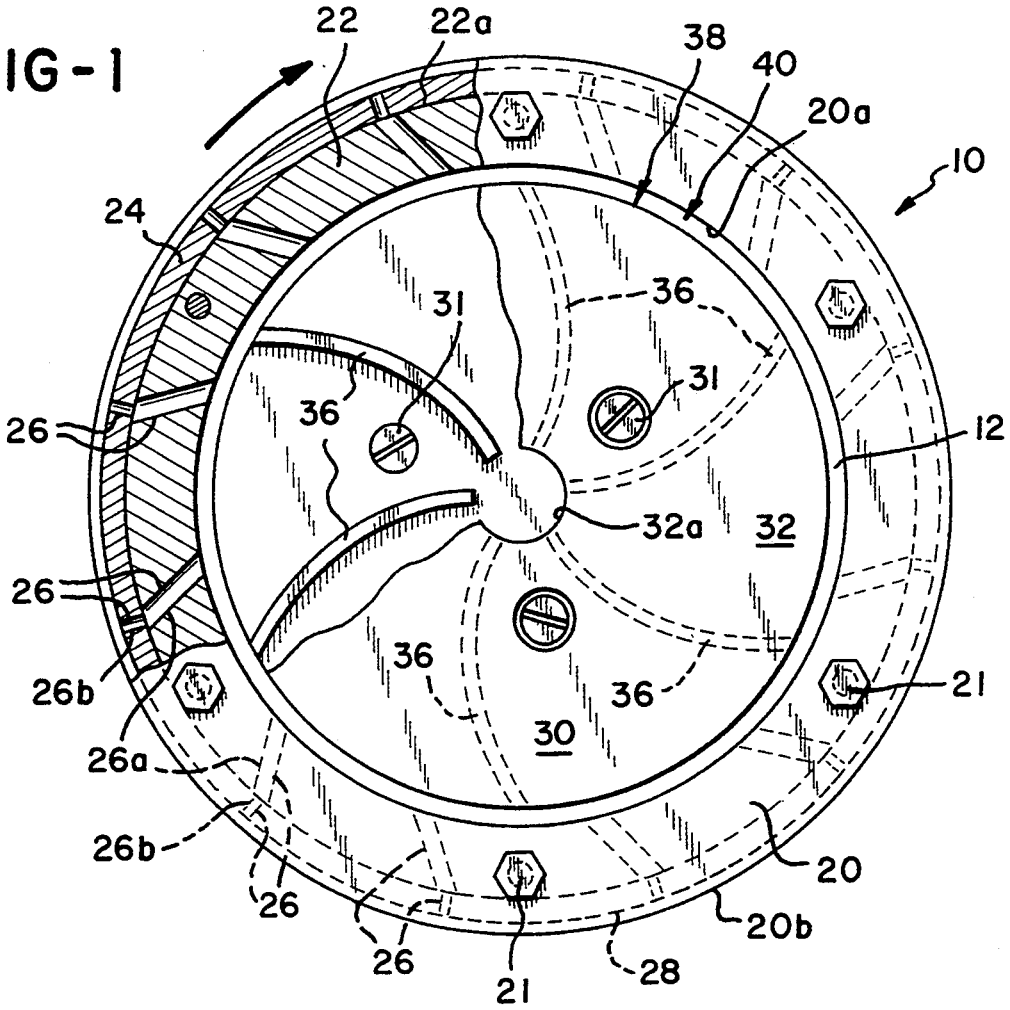
FIG. 1 is a partially broken away plan view of a grinding wheel assembly constructed in accordance with the present invention.
Figure 2:
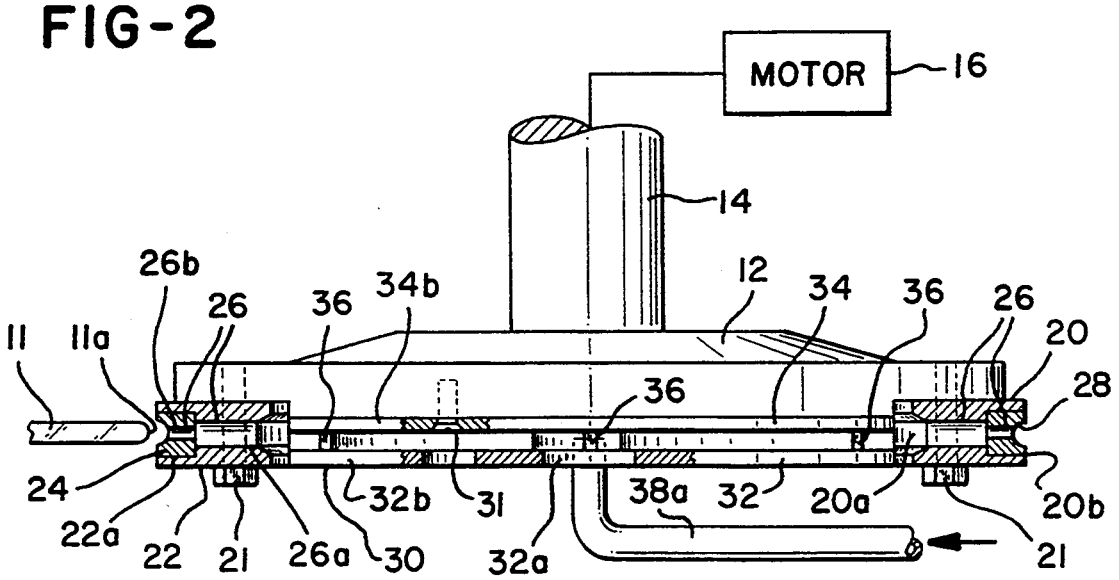
FIG. 2 is a side view, partially in section, of the grinding wheel assembly shown in FIG. 1 shown together with a workpiece and a fluid source; and, FIG. 3 is a view similar to FIG. 2 showing a modified grinding wheel assembly of the present invention.

Reference is now made to FIG. 1, which shows a grinding wheel assembly 10 constructed in accordance with the present invention. The assembly 10 includes a rotatable support member 12 which is coupled to a drive shaft 14 of a drive mechanism, such as an electric motor 16, see FIG. 2. A grinding wheel 20 is fixedly connected to the support member 12 by threaded bolts 21 for rotation therewith. An impeller 30 is positioned within the grinding wheel 20 and is fixedly connected to the support member 12 by threaded screws 31 for rotation with the support member 12 and the grinding wheel 20.

The grinding wheel 20 comprises a metal core 22, e.g., stainless steel, provided with an abrasive material 24, e.g., a diamond/binder mixture, in an outer circumferential recess **22*a* thereof. Alternatively, the grinding wheel 20 may be formed from any abrasive material such as silicon carbide, diamond, carborundum, aluminum oxide, etc., as well as mixtures thereof. The grinding wheel 20 may also be molded from a mixture of any of the listed abrasive materials and a resin such as a phenolformaldehyde thermoset material. The support member 12 and the impeller 30** are preferably formed from a metal, such as stainless steel.

The grinding wheel 20 is provided with a plurality of bores 26 extending between its inner and outer circumferential surfaces **20*a* and 20*b*, respectively. While the grinding wheel 20 is shown in FIG. 1 having twelve bores 26, the number of bores 26 may be varied, for example, twenty-four bores 26 may be provided. Each bore 26 has a first portion 26*a* having a first diameter (e.g., 0.25 in.) and a second portion 26*b* having a second diameter (e.g., 0.125 in.) which is less than the first diameter. The first portion 26*a* extends from the inner circumferential surface 20*a* and the second portion 26*b* extends from the first portion 26*a* and terminates at the outer circumferential surface 20*b*. The first portion 26*a* is located generally obliquely to the inner circumferential surface 20*a* and the second portion 26*b* is located generally perpendicularly to the outer circumferential surface 20*b*, see FIG. 1**.

The grinding wheel 20 is also provided with an outer circumferential channel 28 which communicates with the bores 26. In the illustrated embodiment, the channel 28 has an arcuate profile.

The impeller 30 includes first and second circular plates 32 and 34, respectively. Interposed between the plates 32 and 34 are a plurality of curvilinear vanes 36, six in the illustrated embodiment, which are equiangularly arranged between the first and second circular plates 32 and 34. Each of the vanes 36 is welded or otherwise fixedly secured to the first and second circular plates 32 and 34.

The first plate 32 is provided with an axially positioned opening **32*a* which defines an inlet for receiving a cooling fluid, such as water, from a fluid supply tube 38***a* extending into the opening 32*a*. The fluid received through the opening 32*a* is forced radially outwardly toward the grinding wheel 20 by the curvilinear vanes 36 so that a substantial portion of the fluid passes into the circumferential channel 28 via the bores 26.

The impeller 30 has an outer circumferential edge 38 defined by outer edges 32*b* and 34*b* on the first and second plates 32 and 34. The outer circumferential edge 38 defines a spaced gap 40 with the inner circumferential surface 20*a* of the grinding wheel 20. The distance between the outer edge 38 and the inner surface 20*a* defining the spaced gap 40 may, for example, equal 0.25 in. The injected fluid is normally a recirculated fluid and, hence, carries ground particles. The gap 40 allows for sufficient circulation of the fluid within the assembly 10, which is believed to result due to gravity acting upon the fluid within the gap 40, to prevent a build-up of ground particles on the inner circumferential surface 20*a* and within the bores 26.

Figure 3:
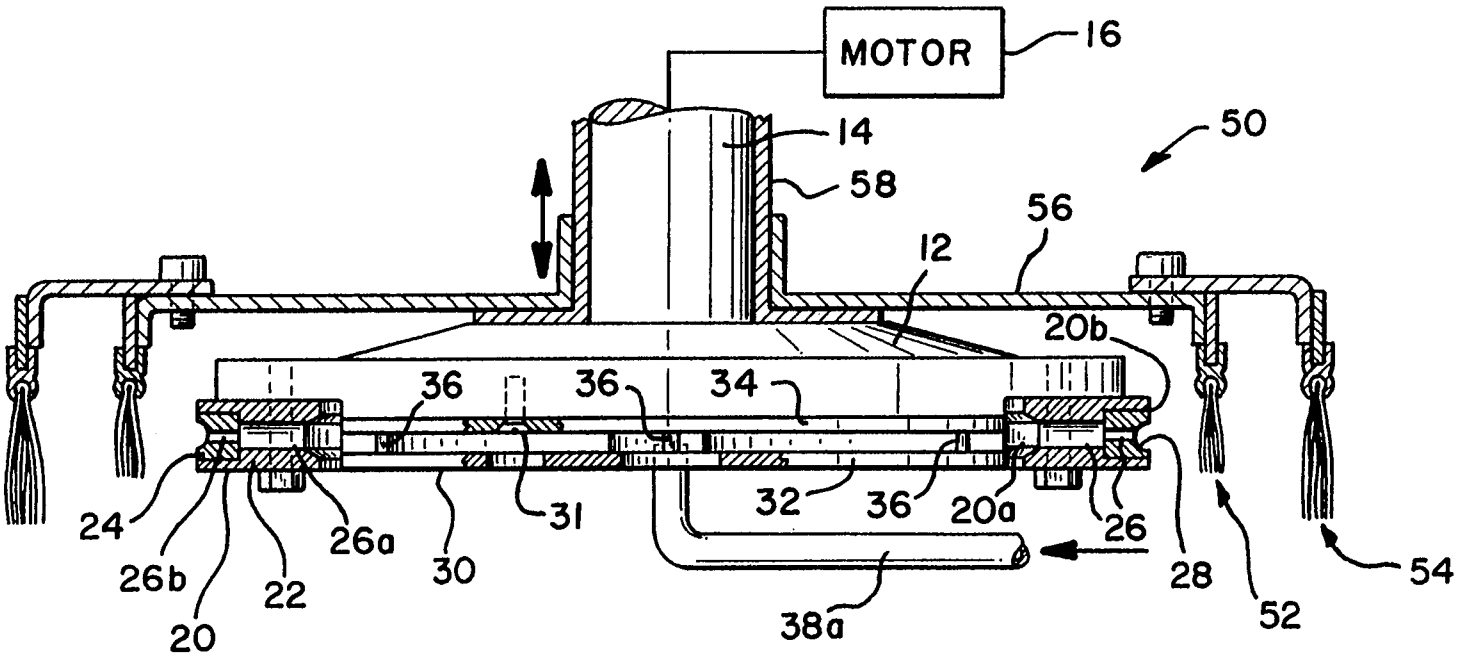

A grinding wheel assembly 50, formed in accordance with an alternative embodiment of the present invention, is shown in FIG. 3, where like elements are referenced by like numerals. In this embodiment, first and second flexible curtains 52 and 54 are provided for containing fluid spray during the grinding process. The curtains 52 and 54 extend generally 360° about the grinding wheel 20 and are secured to a support element 56. The support element 56 is axially movable on a sleeve 58 positioned about the shaft 14. In the illustrated embodiment, each of the curtains 52 and 54 is formed from a plurality of bristles. Alternatively, the curtains 52 and 54 may be formed from polymeric sheets (not shown).

During operation, the grinding wheel assembly is rotated by the motor 16. For finishing the edge 11*a* of a glass sheet 11, see FIG. 2, the preferred rotational speed is generally 3600 RPM. Of course, for other applications, the rotational speed may be varied. A fluid, water in the illustrated embodiment, is injected into the opening 32*a* via the tube 38*a*. The edge 11*a* of the glass sheet is moved relative to the grinding wheel 20 in a direction generally perpendicular to the axis of rotation of the shaft 14. The edge 11*a* is ground by the grinding wheel 20, and is finished with the arcuate profile of the channel 28 against which the edge 11*a* is directed.

The assembly 10 of the present invention has several advantages. For example, during glass sheet edge finishing operations, during which the rotational speed of the grinding wheel 20 is normally 3600 RPM, the impeller 30 accelerates the water at a moderate rate allowing it to reach the high linear velocity of the outer circumferential surface 20*b* of the grinding wheel 20 without first vaporizing. Also, the gap 40 allows for sufficient circulation of the water to prevent a build-up of particles resulting from the grinding operation on the inner circumferential surface 20*b* of the grinding wheel 20 and within the bores 26. Additionally, because the bores 26 communicate directly with the outer circumferential channel 28, the water is delivered directly to the contact area between the glass sheet edge 11*a* and the grinding wheel 20. This permits the feed rate of the glass sheet 11 and the depth of cut to be increased without causing an unacceptable build-up of heat in the grinding area.

Having described the invention in detail and by reference to preferred embodiments thereof, it will be apparent that modifications and variations are possible without departing from the scope of the invention defined in the appended claims.

What is claimed is:

1. A grinding wheel assembly comprising:

a rotatable support member;

a grinding wheel fixedly connected to said support member for rotation therewith and including a plurality of bores extending between inner and outer circumferential surfaces thereof, each of said plurality of bores being enclosed with a tubular inner surface; and an impeller positioned within said grinding wheel and fixedly connected to said support member for rotation with said support member and said grinding wheel, said impeller including an inlet for receiving a fluid, means for forcing said fluid radially outwardly toward said grinding wheel so that at least a portion of said fluid passes through said bores in said grinding wheel and an outer edge which defines a spaced gap with said inner circumferential surface of said grinding wheel.

2. A grinding wheel as set forth in claim 1, wherein said forcing means comprises at least one vane for forcing said fluid radially outwardly toward said grinding wheel.

3. A grinding wheel as set forth in claim 2, wherein said at least one vane comprises at least one curvilinear vane.

4. A grinding wheel as set forth in claim 3, wherein said impeller further comprises first and second circular plates, said at least one curvilinear vane being interposed between said first and second circular plates, and said inlet being axially disposed through said first plate.

5. A grinding wheel as set forth in claim 4, wherein said at least one curvilinear vane comprises a plurality of curvilinear vanes equiangularly arranged between said first and second circular plates.

6. A grinding wheel as set forth in claim 1, wherein each of said bores has a first portion having a substantially constant first diameter along its entire length and a second portion having a second diameter which is smaller than said first diameter, said first portion extending from said inner circumferential surface and said second portion extending from said first portion and terminating at said outer circumferential surface.

7. A grinding wheel as set forth in claim 6, wherein said first portion is located generally obliquely to said inner circumferential surface and said second portion is located generally perpendicularly to said outer circumferential surface.

8. A grinding wheel as set forth in claim 1, wherein said grinding wheel has a circumferential channel formed in its outer circumferential surface.

9. A grinding wheel as set forth in claim 8, wherein said circumferential channel has an arcuate profile.

10. A grinding wheel as set forth in claim 8, wherein said bores communicate with said circumferential channel.

11. A grinding wheel assembly comprising:

a rotatable support member;

a grinding wheel fixedly connected to said support member for rotation therewith and including a plurality of bores extending between inner and outer circumferential surfaces thereof, each of said plurality of bores being enclosed with a tubular inner surface;

an impeller positioned within said grinding wheel and fixedly connected to said support member for rotation with said support member and said grinding wheel, said impeller including an inlet for receiving a liquid and at least one curvilinear vane for gradually accelerating said liquid radially outwardly toward said grinding wheel so that at least a portion of said liquid passes through said bores and across the outer circumferential surface of said grinding wheel.

12. A grinding wheel as set forth in claim 11, wherein said impeller has an outer edge which defines a spaced gap with said inner circumferential surface of said grinding wheel.

13. A grinding wheel as set forth in claim 11, wherein said impeller further includes first and second plates, said at least one curvilinear vane being interposed between said first and second plates, said first plate including an axially positioned opening which defines said inlet, and said second plate including a flat surface located directly across from said axially positioned opening upon which said liquid impinges after being injected into said inlet.

14. A grinding wheel as set forth in claim 13, wherein said at least one curvilinear vane comprises a plurality of curvilinear vanes equiangularly arranged between said first and second plates.

15. A grinding wheel as set forth in claim 11, wherein each of said bores has a first portion having a substantially constant first diameter along its entire length and a second portion having a second diameter which is smaller than said first diameter, said first portion extending from said inner circumferential surface and said second portion extending from said first portion and terminating at said outer circumferential surface.

16. A grinding wheel as set forth in claim 15, wherein said first portion is located generally obliquely to said inner circumferential surface and said second portion is located generally perpendicularly to said outer circumferential surface.

17. A grinding wheel as set forth in claim 11, wherein said grinding wheel has a circumferential channel formed in its outer circumferential surface.

18. A grinding wheel as set forth in claim 17, wherein said circumferential channel has an arcuate profile.

19. A grinding wheel as set forth in claim 11, wherein said at least one curvilinear vane comprises a plurality of curvilinear vanes equiangularly arranged relative to one another.

* * * * *